US011925846B2

(12) United States Patent
Havard et al.

(10) Patent No.: US 11,925,846 B2
(45) Date of Patent: Mar. 12, 2024

(54) SYSTEM FOR CONNECTING A TABLE TENNIS NET TO A TABLE TENNIS TABLE

(71) Applicant: CORNILLEAU SAS, Bonneuil les Eaux (FR)

(72) Inventors: Nicolas Havard, Bonneuil les Eaux (FR); Romain Radreaux, Lihons (FR); Fabrice Clement, Paillart (FR)

(73) Assignee: CORNILLEAU SAS, Bonneuil les Eaux (FR)

( * ) Notice: Subject to any disclaimer, the term of this patent is extended or adjusted under 35 U.S.C. 154(b) by 0 days.

(21) Appl. No.: 17/243,140

(22) Filed: Apr. 28, 2021

(65) Prior Publication Data

US 2021/0339104 A1 Nov. 4, 2021

(30) Foreign Application Priority Data

Apr. 29, 2020 (FR) ..... 2004253

(51) Int. Cl.
*A63B 67/04* (2006.01)

(52) U.S. Cl.
CPC ..... *A63B 67/045* (2013.01)

(58) Field of Classification Search
CPC ..... A63B 67/045; A63B 67/04; A63B 67/10; A63B 2063/005
USPC ..... 273/348, 407; 473/446, 475, 494, 496
See application file for complete search history.

(56) References Cited

U.S. PATENT DOCUMENTS 4,328,605 A * 5/1982 Hutchison ..... F16G 11/101 24/136 R
5,184,798 A * 2/1993 Wilson ..... G08B 13/1463 D8/356
5,215,310 A * 6/1993 Allbright ..... A63B 61/02 473/493
5,823,020 A * 10/1998 Benda ..... E05B 67/003 24/132 R
D430,484 S * 9/2000 Ikeda ..... D8/383
7,059,980 B1 * 6/2006 Shannon, Jr. ..... A63B 71/023 473/494
7,617,574 B2 * 11/2009 Tracy ..... F16G 11/101 24/136 R
8,069,803 B1 * 12/2011 Crawford ..... B63H 25/02 114/144 R
8,424,169 B2 * 4/2013 Gammell ..... A43C 1/00 24/115 G (Continued)

FOREIGN PATENT DOCUMENTS

DE 1197000 B 7/1965
FR 2941626 A1 8/2010

(Continued)

*Primary Examiner* — John E Simms, Jr.

(74) *Attorney, Agent, or Firm* — Muncy, Geissler, Olds & Lowe, P.C.

(57) ABSTRACT

A system for connecting a table tennis net to a table tennis table, the system including a blocking device comprising:

a hollow body (12), at least one orifice (20) being arranged in said body so as to open out at a first end to the outside of the system and at a second end to the inside of the body; and a pusher (13) that is movably mounted in the body to move between a low position in which the pusher allows access to the inside of the body via the second end of the orifice, and a high position in which the pusher blocks access to the inside of the body via the second end of the orifice.

11 Claims, 3 Drawing Sheets

(56) References Cited

U.S. PATENT DOCUMENTS

| | | | | |
|---|---|---|---|---|
| 9,017,296 | B2 * | 4/2015 | Beck | A61M 39/284<br>604/249 |
| D902,714 | S * | 11/2020 | Furner | D9/448 |
| 2016/0001151 | A1 * | 1/2016 | Harvey | A63B 67/04<br>473/493 |
| 2019/0048660 | A1 * | 2/2019 | Huang | E06B 9/78 |

FOREIGN PATENT DOCUMENTS

| | | | |
|---|---|---|---|
| GB | 459384 | A | 1/1937 |
| GB | 671526 | A | 5/1952 |

* cited by examiner

SYSTEM FOR CONNECTING A TABLE TENNIS NET TO A TABLE TENNIS TABLE

The invention relates to a system for connecting a table tennis net to a table tennis table.

BACKGROUND OF THE INVENTION

A table tennis table is provided with a net serving to mark the boundary between two playing portions of the tabletop.

The net is usually held in position by means of a set of two fastener systems, each fastener system being secured both to a respective side of the table and also to a respective end of the net.

In general, one or both of the fastener systems is/are provided with a cleat around which one of the ends of a support wire that stiffens the top margin of the net can be wound.

It is thus found to be relatively awkward to tension the net correctly, in particular so as to ensure that the tension exerted by each end of the support wire is the same.

OBJECT OF THE INVENTION

An object of the invention is to propose a system for connecting a table tennis net to a table tennis table that is simpler to use.

SUMMARY OF THE INVENTION

In order to achieve this object, there is provided a connection system for connecting a table tennis net to a table tennis table, the system including a blocking device comprising:

- a hollow body, at least one orifice being arranged in said body so as to open out at a first end to the outside of the system and at a second end to the inside of the body; and
- a pusher movably that is mounted in the body to move between a low position in which the pusher allows access to the inside of the body via the second end of the orifice, and a high position in which the pusher blocks access to the inside of the body via the second end of the orifice.

As a result, it suffices for a user to push down the pusher in order to release access to the inside of the body: the user can then insert therein a support wire of a table tennis net. The user then releases the pusher: the wire thus becomes blocked inside the body by being jammed between the body and the pusher.

Consequently, the invention enables a support wire for a table tennis net to be blocked easily, and thus enables said net to be properly tensioned.

Advantageously, the invention also enables the wire to be blocked securely, thereby guaranteeing better tension for the net over time.

Throughout the present application, terms such as "bottom", "top", . . . should be understood relative to the in-service position of the table tennis table when it is standing on a floor.

Optionally, the device is itself mounted to move between a top position and a bottom position in the system.

Optionally, when the pusher is in the low position, a top face of the pusher is shaped to co-operate at least with the orifice to form a channel into which a support wire is to be inserted.

Optionally, a groove is arranged in the top face of the pusher, the groove extending in line with the orifice when the pusher is in the low position.

Optionally, at least one second orifice is arranged in the body so as to open out at a first end to the outside of the system and at a second end to the inside of the body.

Optionally, the two orifices face each other.

Optionally, the high position of the pusher is an equilibrium position of the pusher.

Optionally, the blocking device includes return means for returning the pusher to its high position.

Optionally, the top face of the pusher is dished.

Optionally, the top face of the pusher is textured, at least in part.

The invention provides an assembly comprising both a first system and a second as specified above.

Optionally, such an assembly includes a table tennis net.

The invention also provides a table tennis table including at least one system as specified above.

The invention also provides a method of connecting a table tennis net to a system as specified above, the method comprising the steps of:

- pressing the pusher into its low position;
- inserting a support wire of the net into the orifice; and
- releasing the pusher to cause the wire to be jammed between the pusher and the body.

Other characteristics and advantages of the invention appear on reading the following description of a particular, nonlimiting embodiment of the invention.

BRIEF DESCRIPTION OF THE DRAWINGS

The invention can be better understood in the light of the following description given with reference to the accompanying figures, in which.

DETAILED DESCRIPTION OF THE INVENTION

In known manner, a table tennis table includes a tabletop comprising a first tabletop portion presenting a first plane surface and a second tabletop portion presenting a second plane surface.

The tabletop also includes a net marking the boundary between the two tabletop portions. In known manner, the method includes a support wire passing through the top margin of the net and projecting from each end of the margin so as to present a left first end and a right second end that are located outside the net.

The table also includes at least one connection system 1 for connecting the net to the table, and it preferably includes at least two connection systems 1 that are arranged on respective sides of the table, each at the boundary between the two tabletop portions.

Since both connection systems 1 are identical, the following description of one of the connection systems 1 applies equally well to the other one of the connection systems 1.

Figure 1:
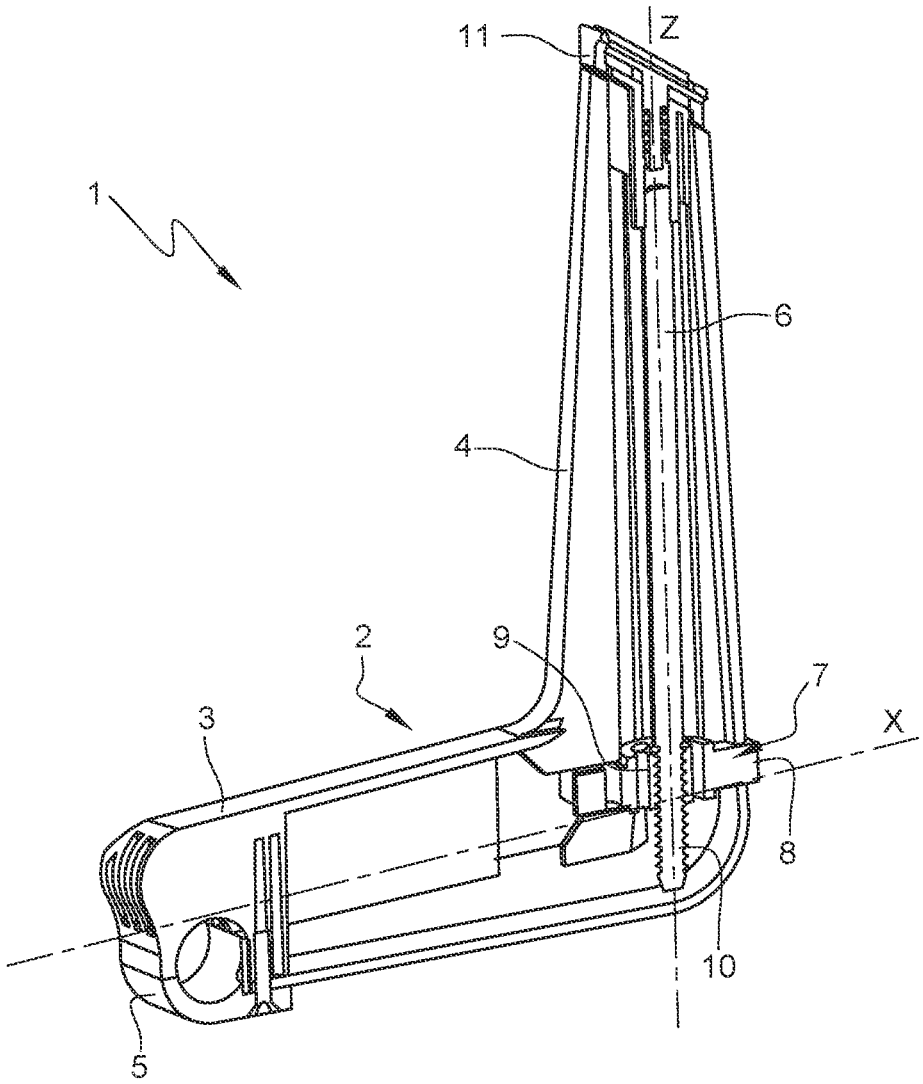
FIG. 1 is a central section view of a system for connecting a table tennis net to a table tennis table in a particular embodiment of the invention.
Figure 2:
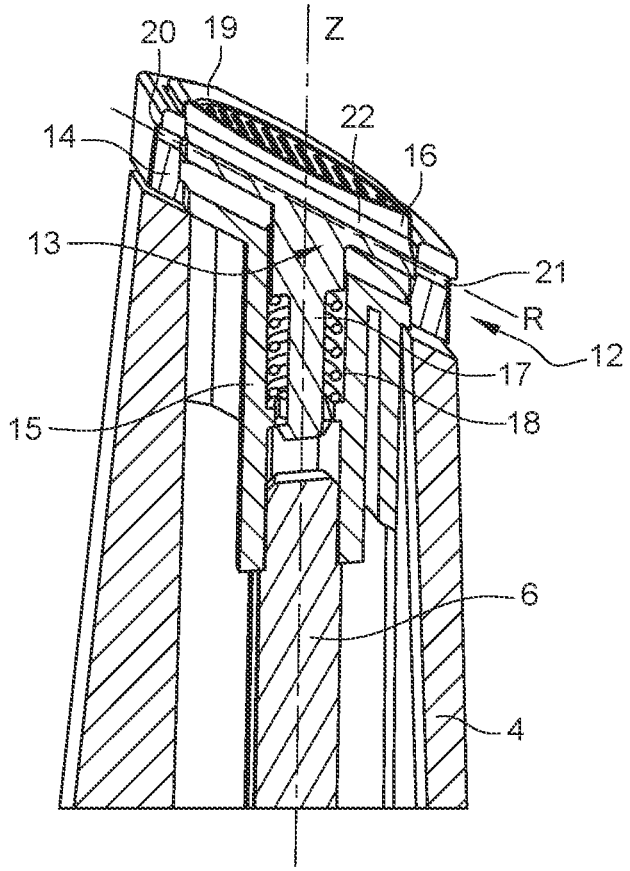
FIG. 2 is a view on a larger scale of a portion of the system shown in FIG. 1.

With reference to FIGS. 1 to 2, the connection system 1 in a particular embodiment of the invention includes a carrier structure 2.

The carrier structure 2 is generally L-shaped, and it thus presents a column 4 having its bottom end extended by a base 3 for attachment to the table. The base 3 is substantially horizontal and it thus extends in a straight line along a first axis X, and the column 4 is substantially vertical and it thus extends in a straight line along a second axis Z orthogonal to the first axis X. The base 3 is provided with means 5 for securing it to the table.

The base 3 is preferably mounted on the table at its free end about an axis that extends parallel to the longitudinal direction of the table.

The base 3 could thus be the base described in patent FR 2 914 626.

The base 3 could thus be the base described in patent FR 2 914 626 with the exception that the free end of the base that is pivotally mounted on the table is made up of two portions, the base 3 also having fastener means for fastening the two portions together. By way of example, these fastener means comprise a screw for fastening the two portions together. It is thus possible initially to position one of the free end portions of the base 3 about the axis, then to put the second portion into place, and finally to fasten the two portions together. The base 3 is then capable of pivoting relative to the table while being well secured thereto.

The column 4 thus has one side facing inwards towards the table and another side facing outwards away from the table. The column 4 is also hollow along its entire length (length considered along the second axis Z).

In order to secure the net to the table, each of the side ends of the net is fastened to the table-facing side of a respective one of the above-mentioned columns 4. The left end of the support wire is fastened to the left connection system and the right end of the support wire is fastened to the right connection system. This also enables the net to be well tensioned.

The connection system 1 also includes a rod 6 extending inside the column 4. In this example, the rod 6 is arranged so as to extend in a straight line along the second axis Z.

The rod 6 is typically mounted in the column 4 to be movable between a low position and a high position. Preferably, the rod 6 is mounted in the column 4 to be slidable between its two positions.

For example, the connection system 1 includes a thumbwheel 7 arranged in the connection system 1 so as to be concentric about the second axis Z.

The thumbwheel 7 is arranged in part only inside the carrier structure 2: only an angular sector 8 of the thumbwheel is thus accessible from the outside. As a result, a user can cause the thumbwheel 7 to turn about the second axis Z relative to the carrier structure 2 by means of said angular sector 8.

The thumbwheel 7 also has a tapped hole 9 passing through it along the second axis Z. In reality, the thumbwheel 7 is arranged around the rod 6, which passes through the tapped hole 9. Preferably, the rod 6 has an outside thread over at least a segment 10 of the rod, the thread of said segment 10 being suitable for co-operating with the tapping of the tapped hole 9.

Optionally, only the bottom segment 10 of the rod 6 has an outside thread, with the thumbwheel 7 thus being arranged in corresponding manner at the level of said segment 10. For example, the thumbwheel 7 is arranged at the bend formed between the base 3 and the column 4.

Furthermore, the connection system 1 includes a blocking device 11 for blocking each of the associated ends of the net support wire.

The blocking device 11 is preferably arranged in the carrier structure 2 at the upper end of the column 4.

Said blocking device 11 comprises a hollow body 12 and a pusher 13 mounted in said body 12.

Optionally, the body 12 includes a receptacle 14 that is extended downwards by an insert 15. The pusher 13 has an active portion 16 on which the user is to act, which active portion 16 is extended downwards by a leg 17. Thus, the active portion 16 of the pusher 13 is housed in the receptacle 14, and the leg 17 extends inside the insert 15, with the leg 17 and the insert 15 extending coaxially relative to each other. Optionally, the insert 15 and the leg 17 are arranged, at least in part, inside the column 4 so as to extend coaxially about the second axis Z.

Preferably, the top end of the rod 6 is fastened to the insert 15 so that the rod 6 and the body 12 are secured to each other. By way of example, the rod 6 is arranged in the low portion of a duct formed in said insert 15 so as to extend along the second axis Z, with the leg 17 extending in the high portion of the duct.

Furthermore, the insert 15 is arranged in a bushing that extends inside the column 4 along the second axis Z so that the insert 15 can slide along said bushing and thus along the column 4 along the second axis Z. Consequently, the body 12 is mounted on the column 4 via a sliding connection. Under such circumstances, the body 12 forms antirotation means for preventing the rod 6 from rotating.

As a result, turning the thumbwheel 7 about the second axis Z in a first direction of rotation drives sliding along the second axis Z of the rod 6, and thus also of the blocking device 11, towards its high position inside the column 4, while turning the thumbwheel 7 about the second axis Z in the opposite direction of rotation drives sliding along the second axis Z of the rod 6, and thus also of the blocking device 11, towards its low position inside the column 4.

It is thus easy to lower or to raise the blocking device 11 relative to the carrier structure 2.

The connection system 1 is preferably arranged in such a manner that when the rod 6 is in its low position, a bottom face of the receptacle 14 rests on a top face of the column 4: as a result, the receptacle 14 lies outside of the column 4 so as to extend it. At the outside junction between the column 4 and the blocking device 11, the column 4 and the receptacle 14 thus both present the same outside section. In contrast, the insert 15 is arranged inside the column 4.

The connection system 1 is also arranged in such a manner that when the rod 6 is in its high position, the receptacle 14 is offset above the top face of the column 4, with only a low portion of the insert 15 then remaining inside said column 4.

The pusher 13 is described in detail below.

The pusher 13 is arranged in the connection system 1 in such a manner that at least the top face 19 of the active portion 16 slopes relative to a horizontal plane. In the present example, the top face 19 slopes relative to a plane that is normal to the second axis Z. Said top face 19 thus slopes down towards the ground outwardly from the table.

The blocking device 11 is thus ergonomic for the user. Typically, the user can put a hand around the column 4 and press against the top face 19 using the thumb of the same hand; the slope of the top face 19 makes this position easy to take up, in particular by avoiding any need for the user to bend the thumb in order to actuate the pusher 13.

Preferably, the top face 19 is dished in order to fit more closely to the rounded shape of the bottom of the user's thumb.

This further improves the ergonomics of the connection system.

Preferably, at least the top face 19 is textured.

This limits any risk of the user's thumb sliding relative to said top face 19.

By way of example, the top face 19 presents ridges.

Also, the pusher 13 is mounted to move into the body 12 between a working position in which the pusher 13 is pushed into the body, and a rest position that is also referred to as its high position. Optionally, the pusher 13 projects from the body 12 when it is in its rest position (but does not project when it is in its working position).

Typically, the pusher 13 is mounted to move in the body 12 by moving in translation only. In the present example, the pusher 13 is mounted to slide in the body 12 along the second axis Z.

Preferably, its rest position is an equilibrium position.

Optionally, the working position is not an equilibrium position.

The blocking device 11 thus includes return means for returning the pusher 13 to its rest position. Typically, the return means comprise a spring 18 surrounding the leg 17 and having one end fastened to the insert 15 and its other end fastened to the leg 17. Thus, when the user presses of the pusher 13, the spring 18 is compressed so that when the user releases the pusher 13, said pusher 13 returns automatically to its rest position under drive from the spring 18.

Furthermore, the body 12 includes at least one orifice 20 passing through at least one of its walls so as to open out both to the outside of the blocking device 11 and also to the inside of the body 12. Said orifice 20 is preferably arranged in the receptacle 14 and it extends along a radial direction R. Optionally, the top face 19 slopes along the same radial direction R.

In a particular embodiment, the body 12 includes a second orifice 21 passing through at least one of its walls so as to open out both to the outside of the blocking device 11 and also to the inside of the body 12. The second orifice 21 is arranged in the receptacle 14 so as to extend in line with the first orifice 20 along the same radial direction R as the first orifice 20. Together, the two orifices 20 and 21 thus form a common channel extending in a straight line along said radial direction R. In this example, the two orifices 20 and 21 are identical.

In a particular embodiment, the channel opens out at a first end in the side of the column 4 facing towards the table, and at a second end in the opposite side of the column 4 facing outwards from the table. Nevertheless, neither of the two orifices 20 and 21 opens out into the top face of the receptacle 14.

In a preferred embodiment, the pusher 13 also forms a portion of the channel defined by the two orifices 20 and 21 when the pusher 13 is in its working position. For example, a groove 22 is formed in the top face 19 so that when the pusher 13 is in its working position the groove 22 extends along the radial direction R between the two orifices 20 and 21. Consequently, the groove 22 is a straight line groove. Preferably, the groove 22 presents a section of diameter that is smaller than the section of the two orifices 20 and 21. This makes it easier to pass the wire along the channel.

The pusher 13 is thus mounted to move in the body 12 in such a manner that, when the pusher is in its rest position, the groove 22 is above the two orifices 20 and 21. The channel is then no longer visible. Also, the pusher 13 blocks access to the inside of the body 12 via the orifices 20 and 21 (as can be seen in FIG. 2, were the pusher 13 is shown in its rest position). In the present example, the bottom of the active portion 16 of the pusher 13 extends between the two orifices 20 and 21.

Furthermore, the pusher 13 is mounted to move in the body 12 in such a manner that, when in the working position, the groove 22 extends between the two orifices 20 and 21, in line with both of them. The channel is thus visible, such that the pusher 13 no longer blocks access to the inside of the body 12 via the two orifices 20 and 21.

Figure 3:
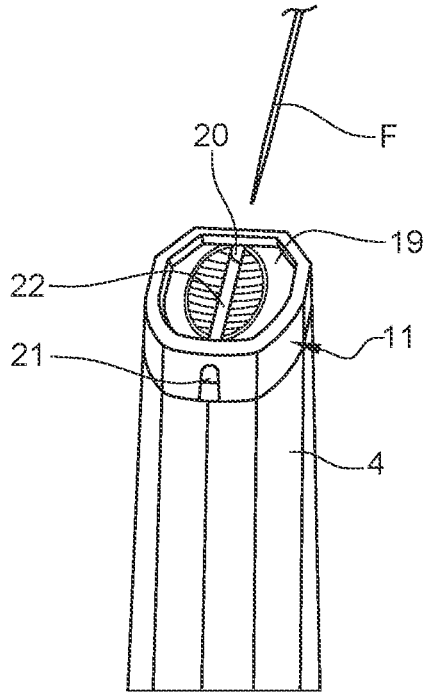
FIG. 3 shows a first step of connecting the net to the system shown in FIG. 1.

In service, and with reference to FIG. 3, the user presses the pusher 13 down via its top face 19 so as to bring it into its working position. The two orifices 20 and 21 and the groove 22 are thus in alignment, such that the channel is visible.

Figure 4:
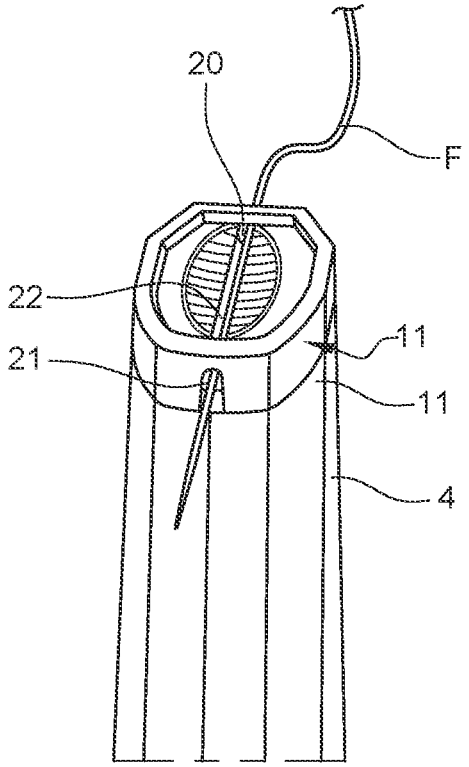
FIG. 4 shows a second step of connecting the net to the system shown in FIG. 1.

As shown in FIG. 4, the user can then insert one of the ends of the net wire F into the channel by inserting the wire F into the first orifice 20 and then pushing it so that the wire F runs along the groove 22 prior to leaving the blocking device 11 via the second orifice 21.

Figure 5:
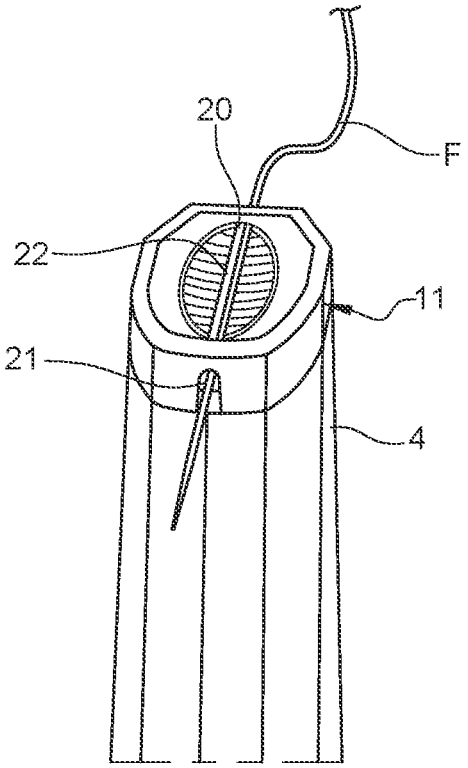
FIG. 5 shows a third step of connecting the net to the system shown in FIG. 1.

The user releases the pusher 13 once the wire F has been pulled hard enough to tension the net properly: the pusher 13 then returns to its rest position, once more blocking the passage between the two orifices 20 and 21 by eliminating the straight line channel. Consequently, the end of the wire F becomes blocked in the connection system 1, as shown in FIG. 5, by being jammed between the pusher 13 and the body 12. More precisely, the end of the wire F forms a first zigzag where it passes between the first orifice 20 and the groove 22 (since when the pusher 13 is in its rest position, the groove 22 lies above the first orifice 20) and it forms a second zigzag where it passes between the groove 22 and the second orifice 21 (since when the pusher 13 is in its rest position, the groove 22 lies above the second orifice 21).

The wire F is thus clamped in two zones and consequently it is deformed. The wire F is thus blocked very securely in the connection system 1.

It should be observed that the groove 22 in the pusher 13 makes it easier to put the wire F into place in the blocking device 11 by guiding the wire F from one orifice 20 to the other orifice 21.

Advantageously, because the groove 22 is formed in the top face 19 of the active portion 16, it is possible for the user to press down the pusher 13 with the thumb of one hand and to insert the wire F into the blocking device 11 with the other hand, the wire F then passing along the groove 22 under the thumb while it is still in place on the pusher 13.

The wire F can thus be arranged in the blocking device 11 simply and quickly.

Naturally, the invention is not limited to the embodiment described above, and variant embodiments may be provided without going beyond the ambit of the invention.

Although above the blocking device and the carrier structure are two different parts of that are secured to each other, the carrier structure and the body of the blocking device could comprise a single part and/or be made integrally as a single piece.

It is possible to omit an assembly for adjusting the relative height between the locking device and the carrier structure. Equally well, such an assembly could exist, but could be other than a thumbwheel and a threaded rod.

Instead of lowering the pusher directly, the connection system could include an assembly enabling the pusher to be actuated indirectly, e.g. by means of the rod and the thumbwheel, which would then serve to raise or to lower the pusher on its own and not the blocking device as a whole.

The pusher could equally well be in equilibrium in its working position: it would then be up to the user to raise said pusher into the rest position in order to block the wire between the pusher and the body.

The pusher need not have a groove. It would be possible to have only one orifice through which the wire is inserted instead of having two orifices.

The invention claimed is:

1. A connection system for connecting a table tennis net to a table tennis table, the system including a blocking device comprising:

a hollow body, at least a first orifice being arranged in said body so as to open out at a first end to the outside of the system and at a second end to the inside of the body and at least a second orifice being arranged in said body so as to open out at a first end to the outside of the system and at a second end to the inside of the body, wherein the second orifice is opposite to the first orifice, wherein the first orifice and the second orifice pass through opposite walls of the hollow body; and a pusher that is movably mounted in the body to move between a low position in which the pusher allows access to the inside of the body via the second end of the first orifice and the second end of the second orifice, and a high position in which the pusher blocks access to the inside of the body via the second end of the first orifice and the second end of the second orifice;

wherein the pusher includes a top face and a groove formed on the top face, when the pusher is in the low position, the groove of the pusher aligns with the first orifice and the second orifice of the hollow body to form a channel into which a support wire is to be inserted to pass the groove of the pusher and the first orifice and the second orifice of the hollow body.

2. The system according to claim 1, wherein the two orifices face each other.

3. The system according to any claim 1, wherein the high position of the pusher is an equilibrium position of the pusher.

4. The system according to claim 1, wherein the blocking device includes return means for returning the pusher to its high position.

5. The system according to claim 1 wherein the top face of the pusher is dished.

6. The system according to any claim 1, wherein the top face of the pusher is textured, at least in part.

7. An assembly comprising, both a first system and a second system according to claim 1 and further comprising a table tennis net.

8. A table tennis table including at least one system according to claim 1.

9. A method of connecting a table tennis net to a system according to claim 1, the method comprising:

pressing the pusher into its low position;

inserting a support wire of the net into the first orifice and the second orifice; and releasing the pusher to cause the wire to be jammed between the pusher and the body.

10. The assembly according to claim 7, wherein the device is itself mounted to move between a top position and a bottom position relatively to the table.

11. A connection system for connecting a table tennis net to a table tennis table, the system including a blocking device comprising:

a hollow body, at least a first orifice being arranged in said body so as to open out at a first end to the outside of the system and at a second end to the inside of the body and at least a second orifice being arranged in said body so as to open out at a first end to the outside of the system and at a second end to the inside of the body, wherein the second orifice is opposite to the first orifice, wherein the first orifice and the second orifice pass through opposite walls of the hollow body; and a pusher that is movably mounted in the body to move between a low position in which the pusher allows access to the inside of the body via the second end of the first orifice and the second end of the second orifice, and a high position in which the pusher blocks access to the inside of the body via the second end of the first orifice and the second end of the second orifice, wherein the pusher includes a top face and a groove formed on the top face, when the pusher is in the low position, the groove of the pusher aligns with the first orifice and the second orifice of the hollow body to form a channel into which a support wire is to be inserted to pass the groove of the pusher and the first orifice and the second orifice of the hollow body, wherein the user presses down the pusher with a finger of one hand and to insert a wire into the blocking device with the other hand, the wire then passing along the groove under the finger while it is still in place on the pusher.

* * * * *